US007143893B2

(12) United States Patent
Kelly

(10) Patent No.: US 7,143,893 B2
(45) Date of Patent: Dec. 5, 2006

(54) MULTIPLE PACK BOTTLE HOLDER

(75) Inventor: Robert L. Kelly, Manchester, CT (US)

(73) Assignee: Jay Packaging Group, Inc., Warwick, RI (US)

( * ) Notice: Subject to any disclaimer, the term of this patent is extended or adjusted under 35 U.S.C. 154(b) by 0 days.

(21) Appl. No.: 10/122,279

(22) Filed: Apr. 12, 2002

(65) Prior Publication Data

US 2003/0192787 A1 Oct. 16, 2003

(51) Int. Cl.
*B65D 75/00* (2006.01)
*B65B 21/00* (2006.01)

(52) U.S. Cl. ..... 206/162; 206/139; 206/427; 53/398

(58) Field of Classification Search ..... D9/344, D9/345; 53/398; 206/139, 145, 147, 158, 206/162, 427, 432, 433, 142, 143, 470, 471; 294/87.2; 40/310
See application file for complete search history.

(56) References Cited

U.S. PATENT DOCUMENTS

| | | | | | |
|---|---|---|---|---|---|
| 2,020,454 | A | | 11/1935 | Bisbee et al. | |
| 3,618,757 | A | | 11/1971 | Funkhouser | |
| 3,784,246 | A | * | 1/1974 | Klygis | 294/87.2 |
| 3,800,998 | A | * | 4/1974 | Gask | 229/406 |
| 3,850,365 | A | * | 11/1974 | Dietrich | 206/427 |
| 4,244,617 | A | * | 1/1981 | Manizza | 294/87.2 |
| 4,664,255 | A | * | 5/1987 | Griffith | 206/162 |
| 4,735,313 | A | * | 4/1988 | Schoenberg | 206/427 |
| 4,872,551 | A | * | 10/1989 | Theros | 206/349 |
| 4,899,877 | A | * | 2/1990 | Kiernan | 206/349 |
| 4,925,019 | A | | 5/1990 | Ganz et al. | |
| 5,052,557 | A | * | 10/1991 | Contino et al. | 206/427 |
| 5,447,232 | A | * | 9/1995 | Chow | 206/378 |
| 5,695,059 | A | * | 12/1997 | Reich | 206/427 |
| 5,775,503 | A | * | 7/1998 | LeBras | 206/427 |
| 5,842,567 | A | * | 12/1998 | Rowe et al. | 206/364 |
| D421,370 | S | | 3/2000 | Hints | |
| 6,325,210 | B1 | | 12/2001 | Henry, Jr. | |

FOREIGN PATENT DOCUMENTS

EP 627 A1 * 2/1979

* cited by examiner

*Primary Examiner*—Mickey Yu
*Assistant Examiner*—J. Gregory Pickett
(74) *Attorney, Agent, or Firm*—Linda M. Buckley; Steven M. Jensen; Edwards Angell Palmer & Dodge LLP

(57) ABSTRACT

A multiple pack bottle holder capable of supporting one or more bottles is provided, the bottles being enclosed over their top portions. The bottle holder package can support the entire weight of the bottles by surrounding a neck and tapered portion just under the rim of each bottle, such that the barrel or a portion of the barrel remains exposed. The package includes foldable first and second sections that are connected by a center section. The package can be closed when buttons on the first section are engaged with corresponding enclosures on the second section. A hand grip can be provided in the first and second sections between cut-outs for the bottles, thereby facilitating gripping of the package.

43 Claims, 10 Drawing Sheets

MULTIPLE PACK BOTTLE HOLDER

FIELD OF INVENTION

The present invention is directed to an article carrier for holding one or more containers, and more particularly relates to a multiple pack bottle holder in which each bottle is supported near its top end.

BACKGROUND OF THE INVENTION

It is known to provide article carriers which are used to package and display containers of food and/or beverages, including bottles of beer, wine, soda, and other drinks. Such article carriers typically provide support over the bottoms of the bottles or along their lengths. The bottles can be enclosed in a corrugated box or other packaging material. Examples of article carriers include U.S. Pat. No. 2,020,454 to Bisbee et al.; U.S. Pat. No. 3,618,757 to Funkhouser; and U.S. Pat. No. 4,925,019 to Ganz et al.

U.S. Pat. No. 6,325,210 to Henry, Jr. discloses a wine bottle package for shipping bottles of wine in a corrugated box 22. A molded pulp tray 30 supports the bottoms of the wine bottles within the box, while a pulp protector 40 holds the tops of the bottles. Flange portions 35 and 48 in the tray and pulp protector, respectively, serve to restrain the bottles from lateral movement within the box 22. Therefore, the patent to Henry, Jr. discloses a package for supporting wine bottles at both the tops and bottoms thereof to prevent damage during shipping.

While it is known to provide article carriers which support bottles from their sides and bottoms, it would be desirable to provide a bottle holder able to carry and support one or more bottles solely from their top portions.

SUMMARY OF THE INVENTION

The present invention relates to a bottle holder and a method of packaging bottles in the bottle holder. The bottle holder can be made to hold a single bottle or a plurality of bottles, e.g., one or more wine bottles. In a single bottle holder, the bottle holder package encloses the top and a portion of the length of a single bottle, but does not include a bottom support. In a multiple pack bottle holder according to the invention, the bottle holder package preferably encloses the bottles around their top portions and extends down the length of each bottle for a distance sufficient to engage the bottles in a holding manner. This distance can depend, for example, on the configuration of the bottles or the packaging materials themselves. Preferably, no bottom support is provided for the bottles. The bottle holder package can support the entire weight of the bottles by surrounding and enclosing a neck, a tapered portion, and a portion of the barrel of each bottle. Preferably, the bottle holder package includes portions which are situated just underneath a rim of each bottle, the package when closed being able to support the entire weight of bottles contained therein.

In a preferred embodiment, a substantial portion of the length of each bottle is not contacted by the bottle holder package, which results in a bottle holder package that houses bottles having their barrels or a portion thereof exposed to the outside, in order to allow a majority of the bottles to remain in full view to consumers, for more convenient handling, and to achieve savings in material costs.

In one particularly preferred embodiment, the package preferably includes at least a first section and a second section that are connected by a center section and configured to be capable of holding one or more bottles. Embodiments containing more than two sections may be desirable based on aesthetics or an increasing ability to hold the bottles. The first and second sections preferably are made of a plastic such as polyvinyl chloride (PVC) or another material, including but not limited to acylonitrile-butadiene-styrene (ABS), polypropylene, polyethylene, polyethylene terephthalate (PET), or polystyrene. Preferably, a clear plastic material is used in order to facilitate viewing of the bottles, although the plastic can be shaded, colored, or opaque as desired. If no internal placard or label is used, the plastic or other material can be solid and partially or completely capable of blocking light.

The plastic sections can be molded into a desired shape for accommodating specific bottles. For example, in one embodiment, the first and second sections can include cut-outs that are preferably complimentary, and more preferably approximately mirror images of each other, for receiving a particular type of bottle. Walls in the first and second sections can be complimentary and include a plurality of gusset-like members, which along the top of the package can include a curved relief for gripping or aesthetic purposes.

Attachment mechanisms are provided in the first and second sections, for example, by positioning a button on one section and a corresponding enclosure on the other section, such that the first and second sections can be attached together to hold the bottles. Other features can include a banner positioned over the cut-outs and including printed information, and a placard inserted within the package to be visible through center panels of the first and second sections.

Optionally, the bottle holder package can be provided with a hand grip within the body of the first and second sections, so as to permit user gripping of the package. Alternatively, a handle projecting outside the package can be substituted for the hand grip. In another example of the present invention, additional support in the form of first and second lower sections can be provided under the first and second sections, to thereby support a portion of the bottle barrel. A single bottle holder, a two-pack holder, or a three-pack holder are within the scope of the invention, as well as packages holding more than three bottles.

Other aspects and examples of the invention are more fully discussed below.

BRIEF DESCRIPTION OF THE DRAWING

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

A bottle holder according to the present invention can be made to accommodate a single bottle or a plurality of bottles. Such bottles can have a flared top or rim, or can be provided with a generally flat top without a rim. For a single bottle holder, the bottle holder package encloses the top portion and a portion or all of the length of a single bottle, but does not include a bottom support. For a multiple pack bottle holder, the bottle holder package preferably encloses the bottles around their top portions and extending down the barrels for a distance sufficient to engage the bottles in a holding manner. This distance can depend, for example, on the configuration of the bottles or the packaging materials themselves. Preferably no bottom support is provided for the bottles.

The present invention will be illustrated by reference to a two-pack bottle holder embodiment which includes two sections which are foldable around a center section to enclose the bottles about their top portions.

Figure 1:
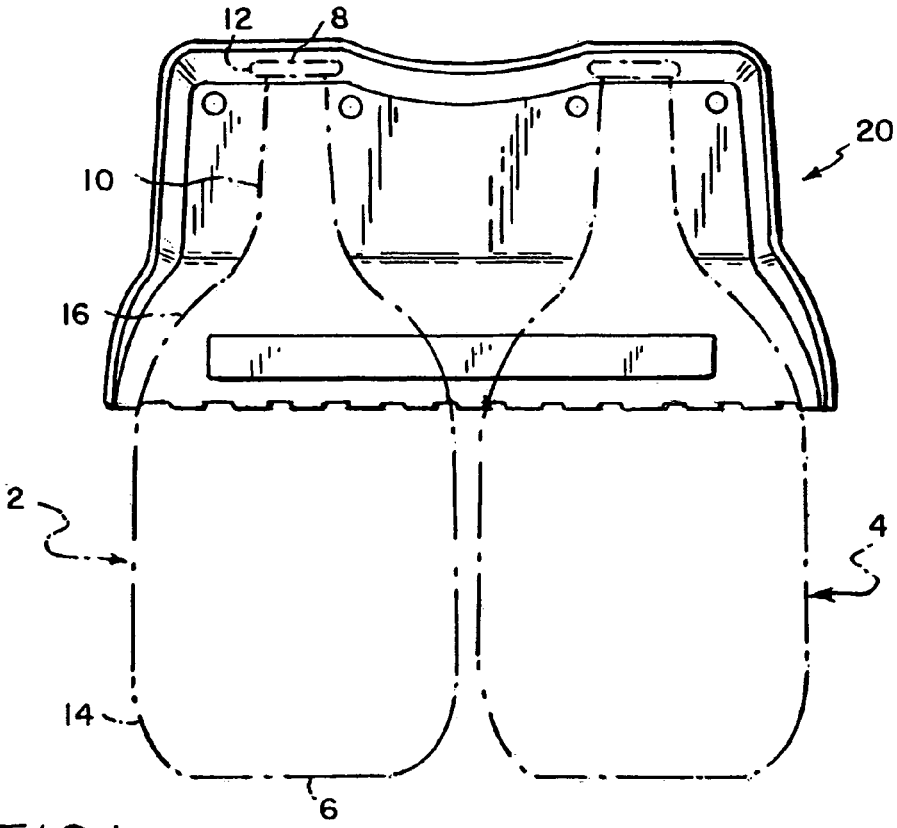
FIG. 1 is a cross-sectional side view of a multiple pack bottle holder according to the present invention holding two bottles.
Figure 2:
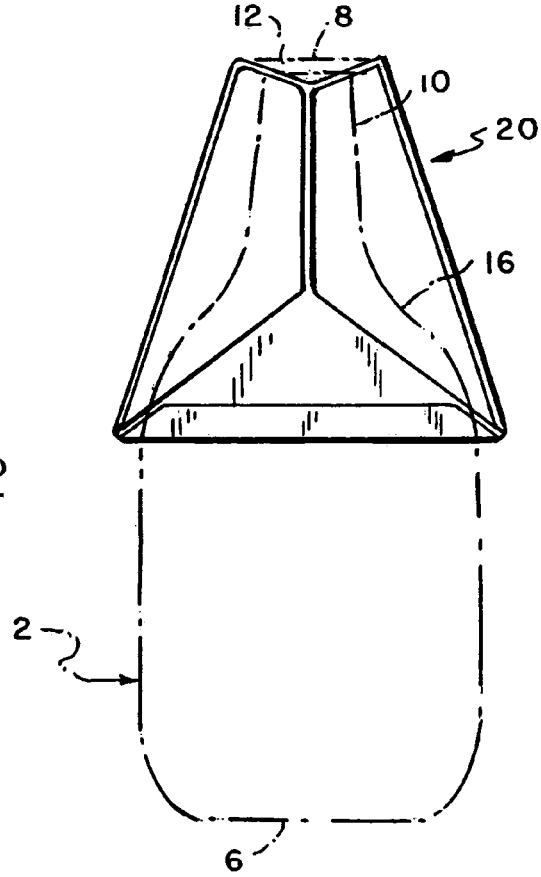
FIG. 2 is an end view of the multiple pack bottle holder and bottles of FIG. 1.

FIGS. 1 and 2 illustrate one embodiment of a multiple pack bottle holder according to the present invention that is formed from a plurality of sections, e.g., first and second side sections and a center section, and configured to contain a plurality of bottles, e.g., two bottles 2 and 4. The bottle holder package 20 can hold and support bottles 2 and 4 from approximately their top portions thereof. For example, the bottle 2 extends between top end 8 and bottom end 6 and is enclosed entirely around a top portion of the bottle, there being no support mechanism that covers the bottom end 6. As used herein, the top portion is defined as any portion of the bottle above the bottom of the barrel 14, and can include all or a portion of the barrel 14, a neck region 10, and a tapered portion 16 having a diameter that gradually narrows between the barrel 14 and the neck region 10. At the top of the neck region 10, the bottle preferably is provided with a flared top portion or rim 12, although other bottles without a rim can be used with the bottle holder of the present invention. Further types of bottles capable of being supported by the bottle holder of the present invention include bottles having a neck but no tapered region, or bottles with a constant diameter neck and no rim.

The bottle holder package 20 can have a generally triangular cross-section, as shown in FIG. 2, such that the package body approximately follows the contour of the bottles, and therefore generally has a narrow profile at the top end 8 of the bottles, which gradually widens through the neck region 10 and into the tapered portion 16 of the bottles.

Figure 3:
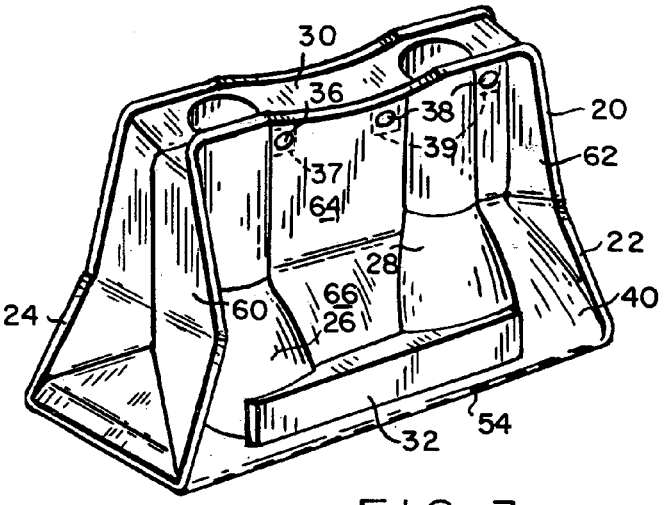
FIG. 3 is a perspective view of the multiple pack bottle holder of FIG. 1.

FIG. 3 is a perspective view of an exemplary multiple pack bottle holder according to the present invention. The bottle holder package 20 preferably is made out of molded plastic or a similar material. Suitable types of plastic include, but are not limited to the following: polyvinyl chloride (PVC), acylonitrile-butadiene-styrene (ABS), polypropylene, polyethylene, polyethylene terephthalate (PET), or polystyrene. The plastic can be contoured to a desired shape through a thermoforming process, as discussed below. Preferably, a clear plastic material is used, in order to facilitate viewing of the bottles contained in the package, although the plastic can be shaded, colored, or opaque as desired. The bottle holder package 20 depicted in FIG. 3 preferably is manufactured as a single piece, or alternatively, multiple plastic pieces can be formed and then fused together. After the bottle holder package is formed through thermoforming, injection molding, or another manufacturing process, the package can be erected to form the bottle holder of the present invention.

Figure 4C:
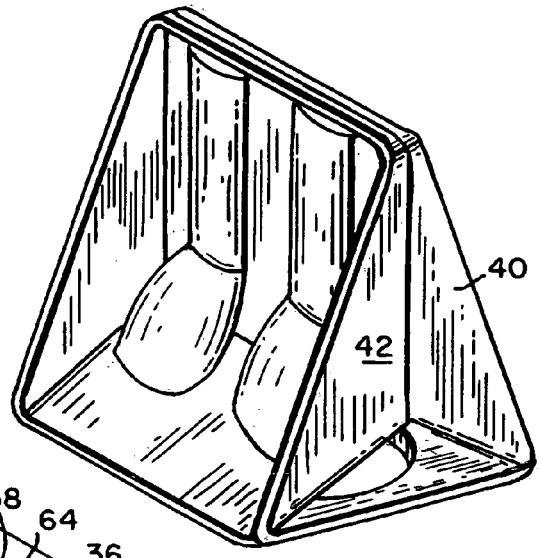
FIGS. 4A–4C are perspective views showing a method of erecting the multiple pack bottle holder according to the present invention.
Figure 4B:
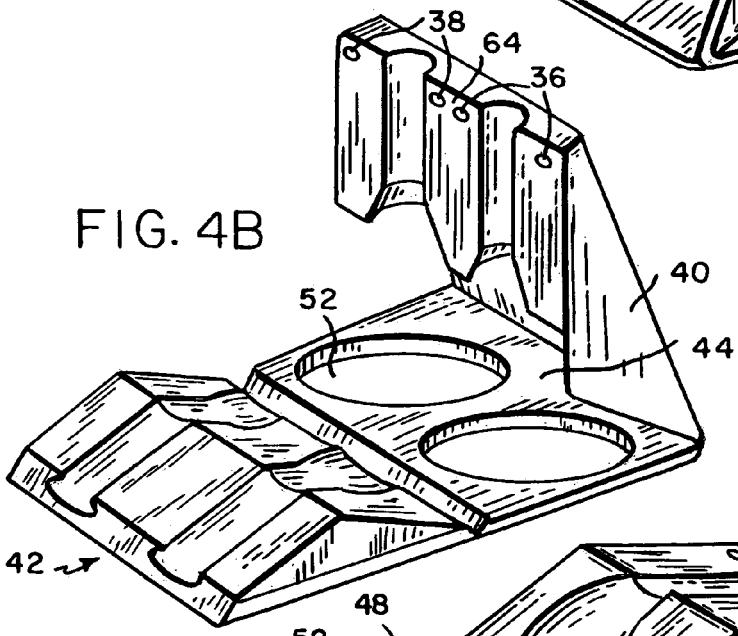
Figure 4A:
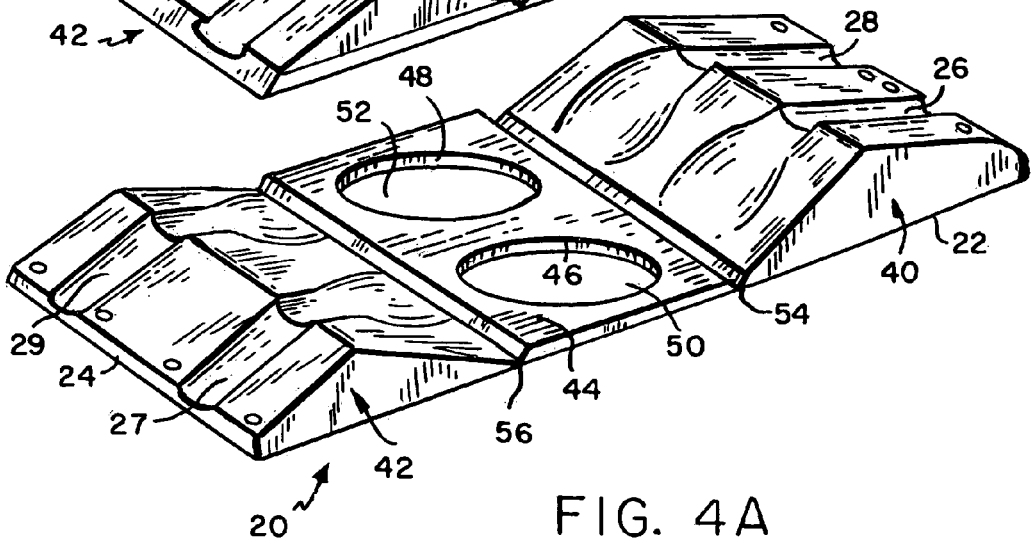

The bottle holder package 20 includes first and second contoured side sections 40 and 42 preferably spaced apart by a center section 44 (see FIG. 4A). The first and second sections 40 and 42 can be molded in accordance with the outline of bottles to be contained therein, where the first and second sections 40 and 42 preferably are shaped so that the bottles can fit snugly within cut-out areas of molded plastic in the first and second sections. For example, as shown in FIGS. 3 and 4A, cut-outs 26 and 28 are configured and arranged to receive bottles; corresponding cut-outs 27 and 29 in the second section 42 are complimentary with the cut-outs 26 and 28. Cut-out 26 and opposed cut-out 27, for example, closely follow the shape of the tapered section and neck of a bottle positioned in the bottle holder package 20.

The bottle holder package 20 can include an outer edge 22 surrounding the first section 40 on at least three sides thereof. The outer edge defines a wall of the first section 40 capable of receiving bottles in the cut-outs 26 and 28, as discussed above, and for joining with an opposite wall formed in the second section 42. The outer edge 22 can be rounded to create a more pleasing appearance and so that users will not suffer injury due to contact with sharp edges. The outer edge 22 defines an outer extent of the first section 40 along each side and the top thereof, with a fold line 54 being provided on the bottom of the first section 40.

The wall formed in the first section includes end panels 60 and 62 which provide strength and structural reinforcement to the bottle holder package. The end panels 60, 62 preferably are gusset-like members provided on the ends of the package and which also extend continuously over the top of the first section 40. As shown in FIG. 3, the top of the bottle holder package 20 includes a gusset-like member shaped to form a curved relief 30 that is curved between the cut-outs 26 and 28 in approximately the middle of the top of the first section 40. The relief 30 can be a smooth surface for gripping the bottle holder package. Optionally, the relief 30 can be omitted and another gripping mechanism can be provided, as discussed further below. Preferably, various gusset-like members are provided continuously over the outer extent of the wall defined by outer edge 22 to provide sufficient strength for supporting the weight of bottles held by the bottle holder package.

The second section 42 (not shown in detail in FIG. 3) is approximately a mirror image of the first section 40, and is provided for receiving and containing bottles. As discussed above, second section 42 preferably includes cut-outs 27 and 29 of molded plastic which are similar in shape and size to cut-outs 26 and 28. Moreover, the second section 42 can be provided with an outer edge 24 on at least three sides thereof (i.e., the top and both ends) and a fold line 56 on the bottom of the package (see FIG. 4A). The outer edge 24 defines a wall positioned opposite the wall in the first section, the wall in the second section having gusset-like reinforcing members complimentary with those in the first section. The outer edge 24 also preferably is rounded to prevent injury.

The first section 40 (and optionally second section 42) also can be provided with a banner area 32. The banner area 32 can be molded or shaped with product identification information or an advertising slogan, or optionally can be capable of receiving a card or sticker inserted inside the package 20. In one preferred use, the banner area 32 is molded with the product name, thereby identifying the wine bottles held by the multiple pack bottle holder as belonging to a particular brand of wine. The banner area can be molded to the contour of the bottles contained in the bottle holder package, or alternatively can be arranged approximately perpendicular to a base of the package.

The first and second sections 40 and 42 can be attached together by complimentary buttons and enclosures or other known attachment mechanisms. In the exemplary bottle holder package depicted in FIG. 3, two buttons are provided around each cut-out 26 and 28, such that one button is positioned on either side of each cut-out 26 and 28. For example, buttons 36 can be positioned around the cut-out 26 (only one button is shown in FIG. 3), and buttons 38 can be positioned around the cut-out 28 on the first section 40. Buttons on the first section preferably can be received in corresponding enclosures (not shown) on the second section. For example, the buttons 38 each can be formed as a projection capable of fitting within a similar sized enclosure on the second section. Conventionally, each button snaps into place within its corresponding enclosure. Such buttons and enclosures preferably are formed by sonic sealing, also known as sonic welding, or by radio frequency (RF) sealing. Other processes for forming the buttons and respective enclosures include blister sealing and heat sealing, or the buttons and enclosures can be replaced by an adhesive or glue. When the buttons are formed by sonic welding or RF sealing, the resulting seal between the button and its respective enclosure is tamper proof, and a mechanical means such as a scissors, knife, or other means is required to open the package. This type of seal ensures that the package is held together when it is subject to stress or other forces.

Optionally, the buttons and enclosures can be provided with perforations 37 and 39 around the buttons 36 and 38, respectively, which allow the user to "pop out" the buttons, thereby eliminating the buttons and corresponding enclosures from the package and forcing the package open. The perforations can be provided to permit easy opening of the package without having to disengage each button from its respective enclosure. However, the perforations are optional and can be omitted without departing from the spirit or scope of the present invention.

Figure 5:
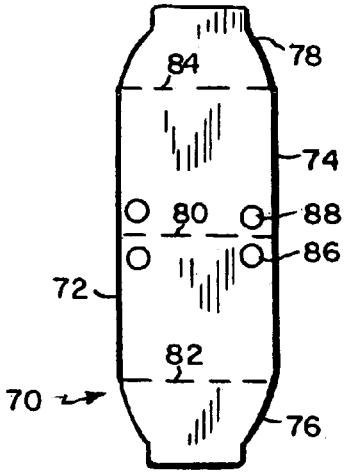
FIG. 5 is a plan view of an exemplary placard insert which can be used with the multiple pack bottle holder.

Another optional feature of the present invention involves the use of a placard 70 that can be placed between the walls of the first and second sections 40 and 42 prior to closing the bottle holder package. A suitable placard is depicted in FIG. 5. Preferably the placard is designed to be complimentary with the walls and other surfaces of the first and second sections 40 and 42. For example, the placard can include first and second body sections 72 and 74 separated by a central fold line 80, the body sections being sized approximately equally with each other so as to substantially cover each other when folded at the fold line 80. The body sections 72 and 74 are each shaped to fit within a top center panel 64 in each wall of the first and second sections 40 and 42 of the bottle holder package (see FIG. 3). Portions of the body sections 72 and 74 can be omitted (not shown) in accordance with particular package designs, for example to accommodate sealing strips (see FIG. 9) or a hand grip (see FIG. 10).

Preferably the body sections contain complimentary holes 86 and 88, respectively, which are sized appropriately to be larger than buttons 36 and 38 on the package 20. If perforations 37, 39 are provided on the package, the holes can be sized so that the perforations fit within the holes. For example, the holes can be circular or square, depending on the particular configuration of the buttons and/or perforations. The placard also preferably is provided with lower flaps 76 and 78, which are separated from their respective body sections 72 and 74 by outer fold lines 82 and 84, respectively. The lower flaps 76 and 78 are also sized approximately equally with each other and shaped to fit within a bottom center panel 66 in each wall of the first and second sections 40 and 42 of the bottle holder package. The placard can contain writing on body sections 72, 74 and/or lower flaps 76, 78, including text or pictures such as advertising information, product identification logos, one or more coupons, or other information pertaining to the wine bottles or other containers held by the bottle holder package. The other side of the placard also can contain printing, such as a listing of ingredients or other product information.

The exemplary multiple pack bottle holder depicted in FIG. 3 is designed to hold 1.5 liter wine bottles, but the bottle holder can hold other sizes of wine bottles (such as 0.75 liter bottles) or other types of bottles generally, including but not limited to bottles containing liquor, beer, water, soda, juices, other beverages, food, or other contents. Preferably, the first and second sections 40 and 42 are provided with walls which closely follow the shape and contour of the particular bottles being packaged, in order to adequately support the weight of the bottles. As shown in FIG. 1, the weight of the bottles is supported entirely around approximately a top portion of the bottles, preferably in the upper one-half of the vertical extent (length) of the bottles. The bottle holder package preferably supports the bottles by containing each bottle at its tapered section 16, neck region 10, and rim 12. By supporting the bottles over the upper one-half of the bottles and providing a bottle holder package 20 made of clear plastic, the bottles are almost entirely visible to consumers, and thus it is possible for consumers to read labels printed on the bottles and otherwise investigate the quality and consistency of the wine or other beverage or food contained in the bottles without the need to alter or destroy the bottle holder package. Optionally, the package can be shaded, colored, or opaque as desired. In other embodiments of the present invention, the bottle holder package can include walls and cut-outs of the first and second sections which extend down a portion or all of the barrel 16, depending on the configuration and weight of the bottles and the type of packaging materials used.

A method of making the bottle holder package of the present invention will now be discussed. In general, the package 20 can be made of plastic, preferably clear plastic, that is molded and/or shaped to the desired configuration. The bottle holder can be manufactured by a thermoforming process (i.e., vacuum forming process), which is known in the art. According to the thermoforming process, a flat sheet of polymer material can be rigidly mounted on a chain pin system and then moved to a high temperature environment where it is heated until soft and rubbery. When the sheet is sufficiently soft, it can be moved to a mold station, and through application of pneumatic or hydraulic forces, the sheet is stretched and shaped against a lower temperature mold surface. During this step, the plastic can be engraved with desired markings, e.g., over the banner area, as previously discussed. The sheet is then held against the mold surface until it cools sufficiently and stiffens to remove scrap material. Trimming, such as by steel rule die cutting, is undertaken to remove the scrap material, and the plastic bottle holder can be die cut to the desired final configuration. The above-mentioned process of making the package 20 is provided for illustration purposes only, and is generally known to those of skill in the art. Another conventional process such as injection molding can be used to manufacture the bottle holder package.

A method of packaging bottles using the bottle holder package will be described with reference to FIGS. 1, 2, and 4A–4C. (Note that FIGS. 4A–4C are not dimensionally accurate or on the same scale as FIG. 3, but rather are provided to illustrate the method of erecting a bottle holder package according to the present invention.) Initially, the package 20 is provided with edges 22 and 24 of first and second sections 40 and 42, respectively, disposed horizontally in a flat plane. The walls in the first and second sections include cut-outs 26 and 28, and cut-outs 27 and 29, respectively, which preferably are complimentary with each other, as discussed above. As shown in FIG. 4A, the walls in each section also include various inclined portions, which function to receive and support a plurality of bottles, preferably two bottles as shown, although packages containing another quantity of bottles can be provided. First and second sections 40 and 42 are separated by the center section 44, which has plastic rims 46 and 48 defining generally circular openings 50 and 52, respectively, for receiving the bottles.

As shown in FIGS. 4B and 4C, to erect the bottle holder package, the first section 40 is folded along fold line 54 to a generally upright position in which the top center panel 64, e.g., is at approximately a 90° angle relative to the flat plane formed by the center section 44. Thereafter, the second section 42 is folded along fold line 56 and brought up to a similar upright position, such that the first and second sections are positioned adjacent each other. As a result of the molding process, the first and second sections 40 and 42 have already been shaped to be complimentary with each other and to accommodate a specific size of bottles. With first and second sections 40 and 42 each in an upright position, buttons 36 and 38 on the first section 40 are aligned with corresponding enclosures on the second section 42. Prior to engagement of the buttons and their respective enclosures, optionally a placard can be inserted over the top central panel and/or bottom central panel of the first and second sections. If desired, a card or insert can be placed in the banner area (not shown in FIGS. 4A–4C).

Wine bottles or other bottles are then introduced through circular openings 50 and 52 in the center section 44. For example, the partially erected bottle holder package 20 can be lowered over two bottles positioned close together on a conveyor, such that the rim areas 46 and 48 surround and move over the top and neck of each bottle to rest over the tapered area 16 at the top of the barrel 14. Once the bottle holder package 20 is arranged in a desired position relative to the bottles, preferably with the top of the package positioned just under the rims of the bottles, the package can be closed, as seen in FIG. 4C, such that the buttons are engaged with respective enclosures.

The finished package can appear similar to the bottle holder package shown in FIGS. 1 and 2. As shown therein, the bottle holder package 20 is engaged around first and second bottles 2 and 4, covering approximately an upper one-half of each bottle over the tapered portion 16 and neck region 10. As shown particularly in FIG. 2, the molded plastic making up the bottle holder package 20 is shaped to engage the neck region 10 under the rim 12. Bottles 2 and 4 are supported in part by engagement of the rim over adjacent molded plastic portions of the package 20. The weight of the bottles can then be distributed throughout the structure of the package 20.

Figure 6A:
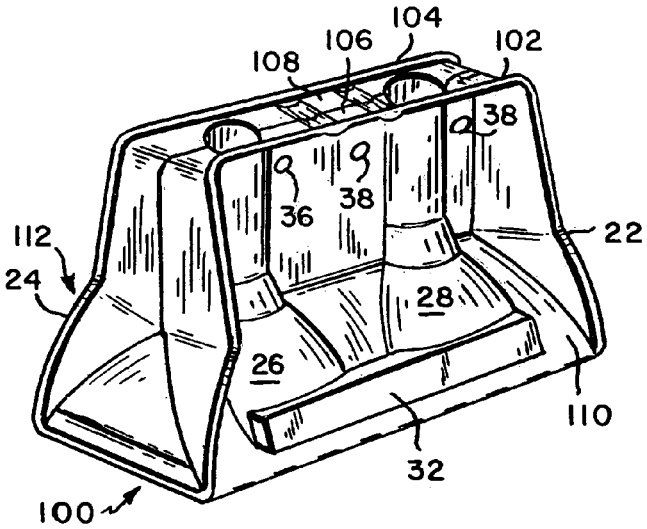
FIG. 6A is a perspective view of a second example of the multiple pack bottle holder of the present invention.
Figure 6B:
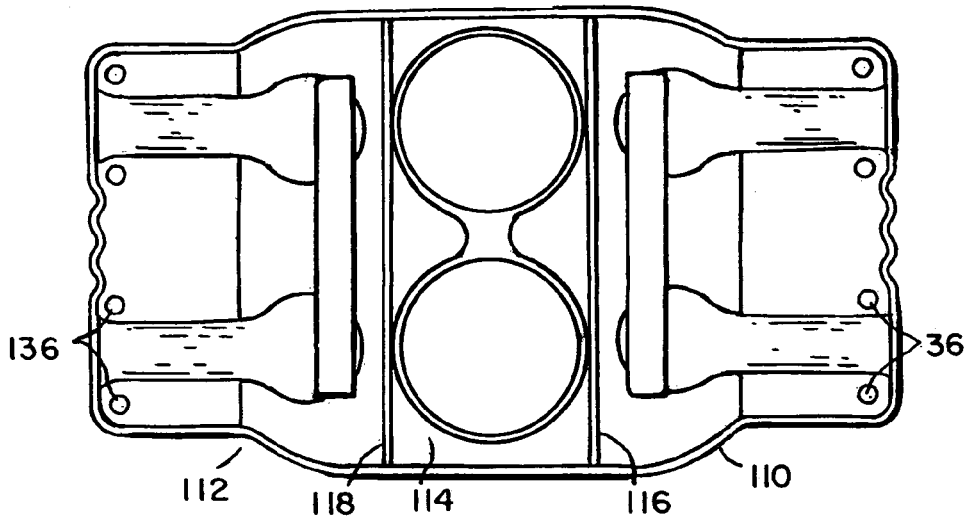
FIG. 6B is a top plan view of the multiple pack bottle holder of FIG. 6A prior to being erected.
Figure 6C:
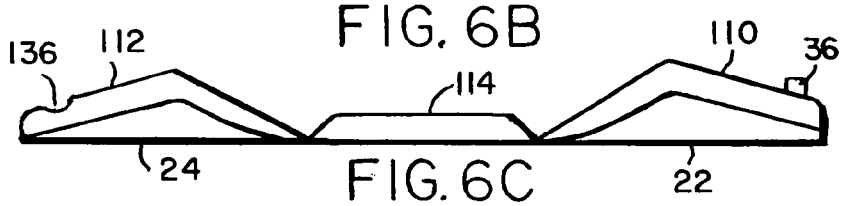
FIG. 6C is a cross-sectional side view of the multiple pack bottle holder of FIG. 6B.

A second example of the multiple pack bottle holder of the present invention is depicted in FIGS. 6A–6C. As shown in FIG. 6A, a bottle holder package 100 according to a second example of the present invention is structurally similar in many respects to the package 20 depicted in FIG. 3. Accordingly, certain similar parts in FIG. 6A are labeled with identical reference numbers as in FIG. 3. The bottle holder package 100 can include first and second sections 110 and 112 spaced apart each other by a center section 114 (see FIG. 6B). Fold lines 116 and 118 connect the first and second sections, respectively, to the center section. As shown in FIG. 6A, the first section 110 can include an outer edge 22 defining a wall, and the second section 112 can include an outer edge 24 defining a wall that preferably is complimentary with the wall of the first section. The first and second sections 110 and 112 include cut-outs 26 and 28 for receiving bottles, and further are provided with buttons 36, 38 and respective enclosures (not shown), as described with reference to FIG. 3.

The bottle holder package 100, as distinguished from the package 20, includes flat top edges 102 and 104 on the first and second sections 110 and 112, respectively. Therefore, as shown in FIG. 6A, no curved relief is provided at the top of the package 100. Instead, a wavy finger pattern is provided to assist the user in gripping the bottle holder package. However, it is also possible to include a curved relief in conjunction with the wavy finger pattern. The walls of the first and second sections 110 and 112 preferably include the gusset-like members previously described. At the top of the package 100, the gusset-like members include alternating ridges and valleys 106 and 108 on the walls of the respective first and second sections 110 and 112, the ridges and valleys on each wall being complimentary with each other. The ridges/valleys 106 and 108 form the wavy finger pattern and can be sized to accommodate fingers of typical users.

The bottle holder package 100 can be erected in the manner described with reference to FIGS. 4A–4C. As shown in FIGS. 6B and 6C, initially the package is laid flat, with edges 22 and 24 of the first and second sections 110 and 112, respectively, positioned in a generally flat plane. Thereafter, the package 100 can be erected, whereupon the buttons 36 of the first section 110 can be engaged with respective enclosures 136 of the second section 112 to hold the bottles.

Figure 7A:
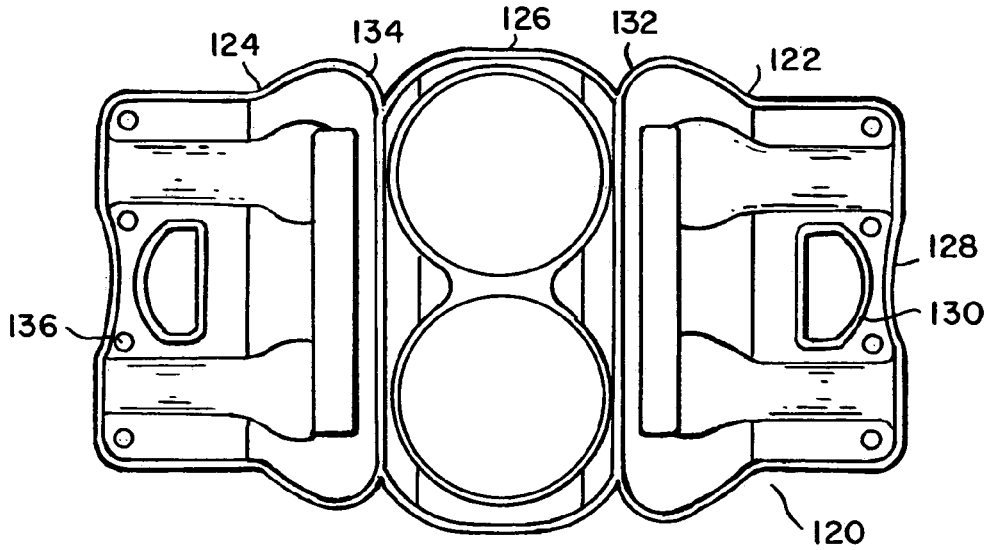
FIG. 7A is a top plan view of a third example of the multiple pack bottle holder of the present invention.
Figure 7B:
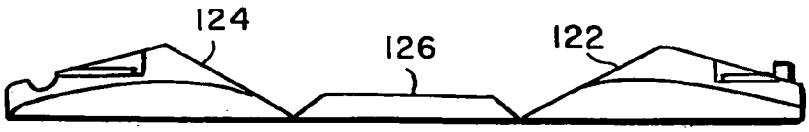
FIG. 7B is a cross-sectional side view of the multiple pack bottle holder of FIG. 7A.

FIGS. 7A and 7B illustrate a third example of a bottle holder package 120 of the present invention. The bottle holder package is similar in many respects to the previously described packages, e.g., including first and second sections 122 and 124, respectively, connected by fold lines to a center section 126. The package 120 does not include the wavy finger pattern as in FIGS. 6A–6C, but instead includes a curved relief 128 similar to that provided in FIG. 3. The package 120 also includes a hand grip 130 with sections thereof formed in both the first and sections 122 and 124, each section of the hand grip being complimentary with the other. Portions of the hand grip can extend between the buttons and corresponding enclosures on the package. The hand grip 130 is defined by an opening formed in both sections of the package, thereby permitting a user to extend one or more fingers through the hand grip to grip the package. The hand grip can be provided in a variety of shapes and as shown is an oval-rectangular shape, the oval-rectangular shape being one preferred shape suitable for gripping. The package of FIGS. 7A and 7B further includes edges in the first and second sections 122 and 124 which include rounded portions 132 and 134, respectively, arranged at portions of the first and second sections adjacent the center section 126, such that when erected, the package includes rounded lower portions, which tend to create a more pleasing appearance and can reduce the effect of sharp edges.

Additional exemplary bottle holder packages will now be discussed. For each of the further examples of the present invention, only features different from the above-described first and second examples of the invention will be described in detail.

Figure 8:
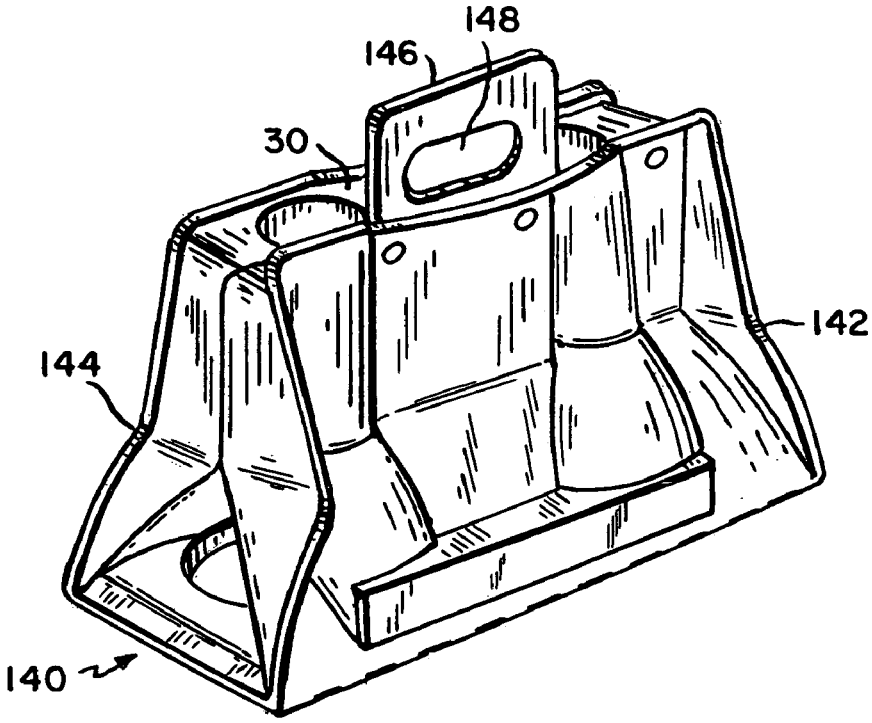
FIG. 8 is a perspective view of a fourth example of the multiple pack bottle holder of the present invention.

FIG. 8 illustrates a fourth example of a bottle holder package 140 of the present invention. In FIG. 8, first and second sections 142 and 144 are provided with cut-outs and other complimentary parts, as previously described, including a curved relief 30 (the same as the curved relief previously described with respect to FIG. 3). As distinguished from previous examples, the example depicted in FIG. 8 includes a handle 146 projecting outside the package 140. Preferably, the handle 146 extends above the top center of the package in the area between the cut-outs for receiving bottles. The handle 146 can be provided with an opening 148 for gripping the bottle holder package. As shown in FIG. 8, extra material can be left in and folded over above the opening 148, in order to protect the user from sharp edges.

Figure 9:
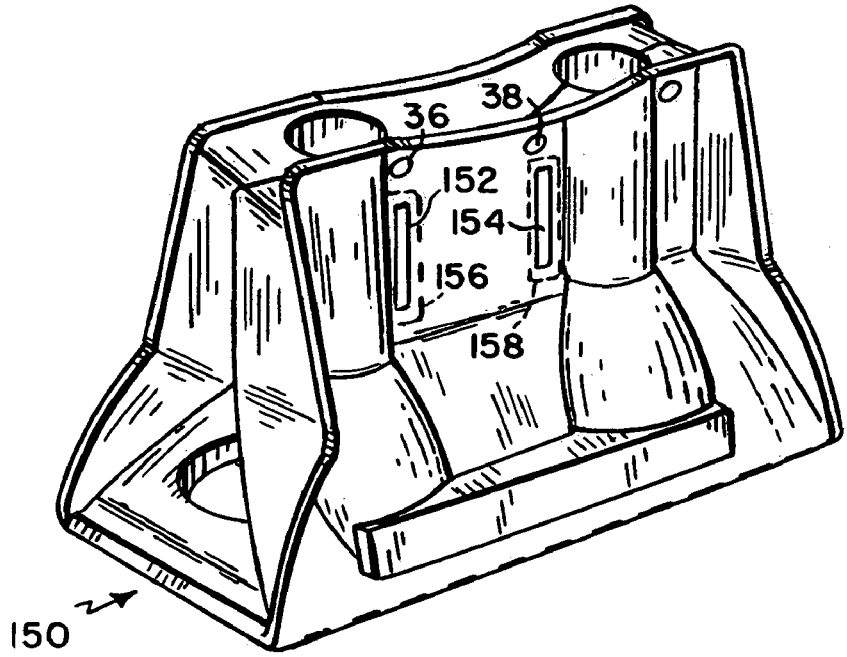
FIG. 9 is a perspective view of a fifth example of the multiple pack bottle holder of the present invention.

FIG. 9 illustrates a fifth example of a bottle holder package 150 according to the present invention. In FIG. 9, the first section, e.g., includes sealing strips 152 and 154 positioned below buttons 36 and 38, respectively, and located preferably between the cut-outs for bottles. Each sealing strip preferably includes a corresponding enclosure in the second section, the enclosure being sized to receive the sealing strip. The sealing strips provide further structural reinforcement to hold together the bottle holder package 150. The sealing strips 152 and 154 optionally can be surrounded by perforations 156 and 158, for allowing the sealing strips to be "popped out" instead of requiring disengagement of each sealing strip from its corresponding enclosure prior to opening the package.

Figure 10:
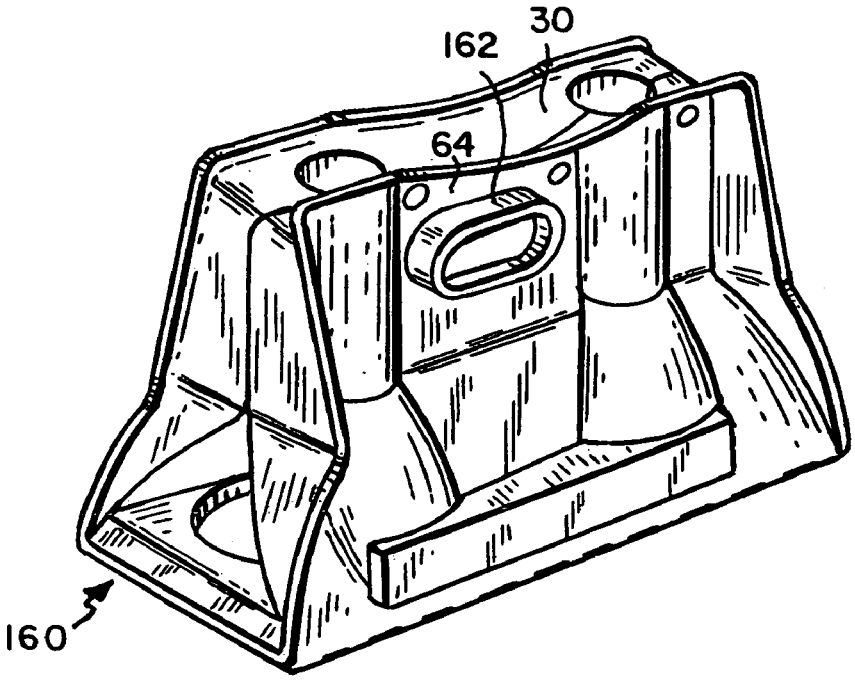
FIG. 10 is a perspective view of a sixth example of the multiple pack bottle holder of the present invention.

FIG. 10 illustrates a sixth example of a bottle holder package 160 of the present invention. In FIG. 10, the first and second sections can include a hand grip 162, the hand grip preferably having portions formed on each section and formed in a generally circular or oval shape with a central opening for gripping the package 160. Preferably, the portions of the hand grip on each of the first and second sections are complimentary, thereby allowing the user to insert one or more fingers through the hand grip 162 and thus through the package 160. The hand grip 162 can be spaced a desired distance below the relief 30 on the walls of the first and second sections. Portions of the hand grip 162 can extend between the buttons and corresponding enclosures.

Figure 11:
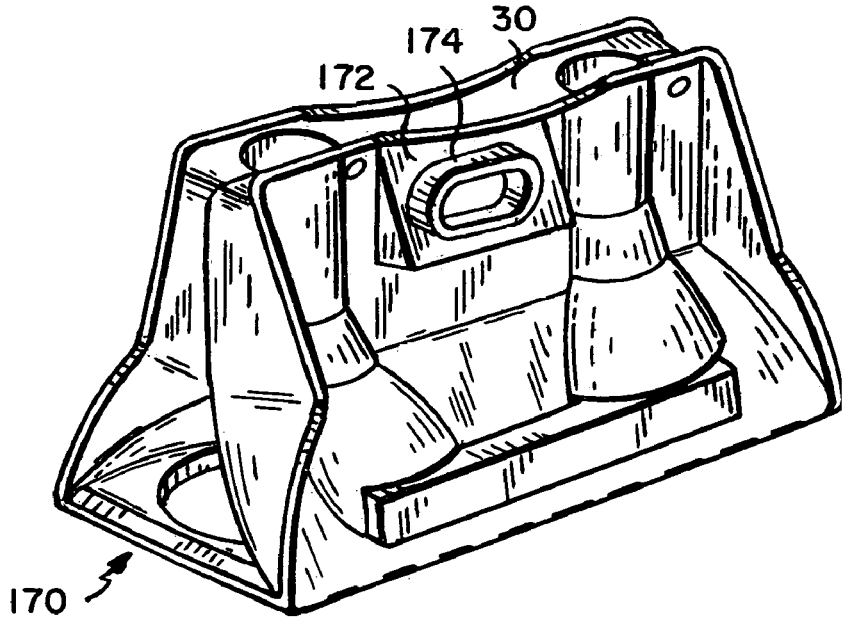
FIG. 11 is a perspective view of a seventh example of the multiple pack bottle holder of the present invention.
Figure 12:
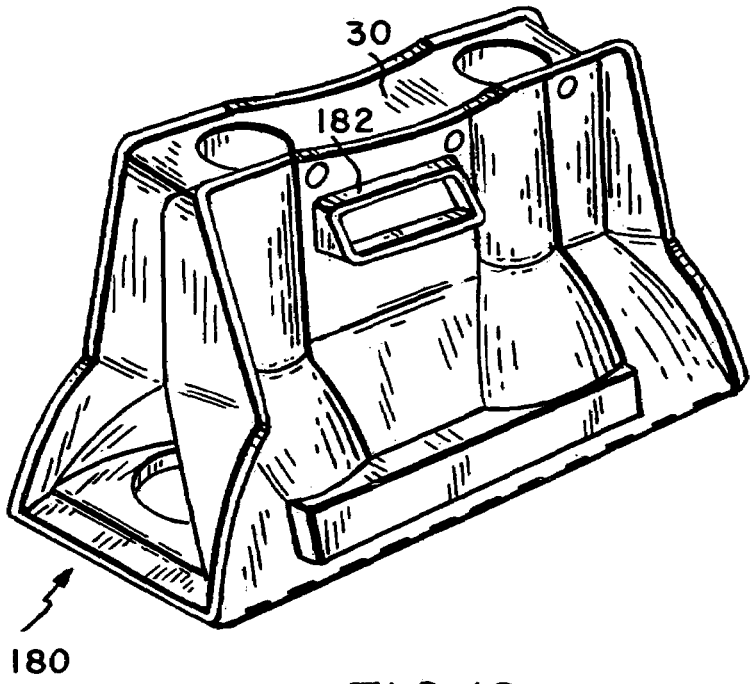
FIG. 12 is a perspective view of a eighth example of the multiple pack bottle holder of the present invention.
Figure 13:
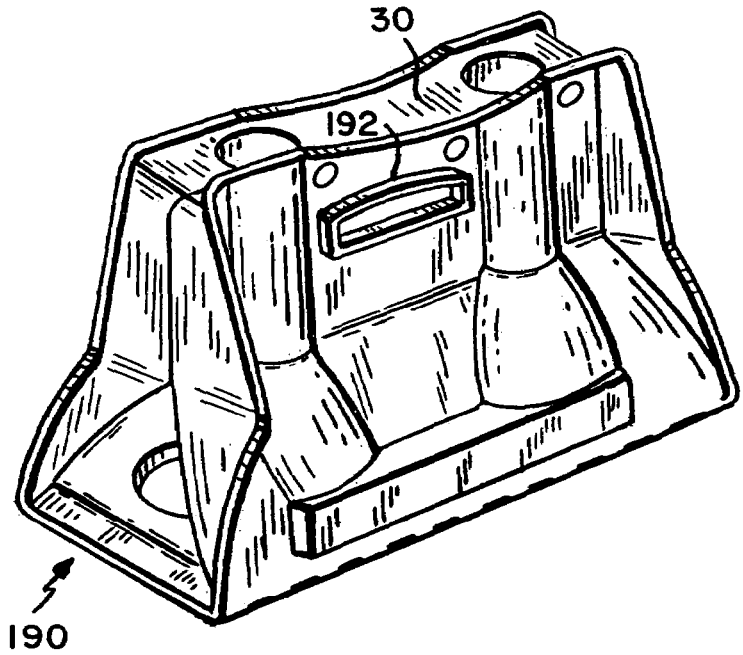
FIG. 13 is a perspective view of an ninth example of the multiple pack bottle holder of the present invention.

FIGS. 11–13 depict further examples of bottle holder packages having a hand grip. In FIG. 11, according to a seventh example of the present invention, a bottle holder package 170 can include a hand grip 174 arranged on a support 172 having a generally triangular cross-section, the support providing structural reinforcement for the hand grip. The hand grip 174 preferably can be circular or oval-shaped. Identical portions of the hand grip 174 and support 172 can be provided on each of the first and second sections of the bottle holder package 170. The support 172 preferably is positioned between buttons and corresponding enclosures on the package 170 and can extend up to or just below the top edge of each section.

In FIG. 12, according to an eighth example of the present invention, a bottle holder package 180 can include a hand grip 182 having a generally rectangular shape and a triangular cross-section. In FIG. 13, according to an ninth example of the present invention, a bottle holder package 190 can include a hand grip 192 combining features of the aforementioned circular/oval and rectangular shaped hand grips, wherein approximately one-half of the hand grip has a circular/oval shape and the other one-half has a rectangular shape. Other modifications to the shape, size, or cross-section of the hand grip are possible without departing from the spirit or scope of the present invention.

Figure 14:
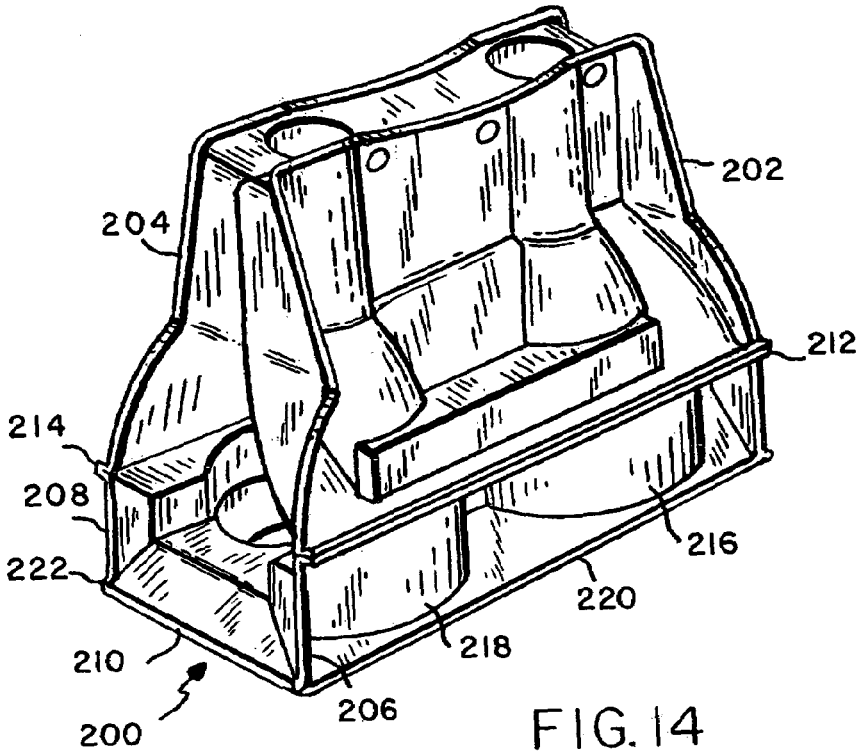
FIG. 14 is a perspective view of a tenth example of the multiple pack bottle holder of the present invention.

FIG. 14 illustrates a further exemplary bottle holder package 200 according to the present invention. In FIG. 14, the bottle holder package 200 includes cut-outs in the first and second sections which extend over a portion of the barrel of each bottle. Such a partial barrel support is especially useful for applications in which exceptionally heavy bottles are to be supported, e.g., bottles over 1.5 liters, although such a structure can be used on smaller bottles.

As shown in FIG. 14, the bottle holder package 200 includes first and second sections 202 and 204, respectively, which can enclose top portions of bottles, including the rim, neck, and tapered section of each bottle, as previously described. The bottle holder package 200 further includes first and second lower sections 206 and 208, respectively, for supporting an upper portion of bottle barrels, support being provided adjacent the tapered sections of the barrels. Lower section 206 is connected to first section 202 and center section 210 by fold lines 212 and 220, respectively. Similarly, lower section 208 is connected to second section 204 and center section 210 by fold lines 214 and 222, respectively. The bottle holder package 200 can be erected in the manner previously described, with lower sections 206 and 208 being folded to approximately a 90° angle to the center section 210 before attachment mechanisms on the first and second sections are engaged.

Figure 15:
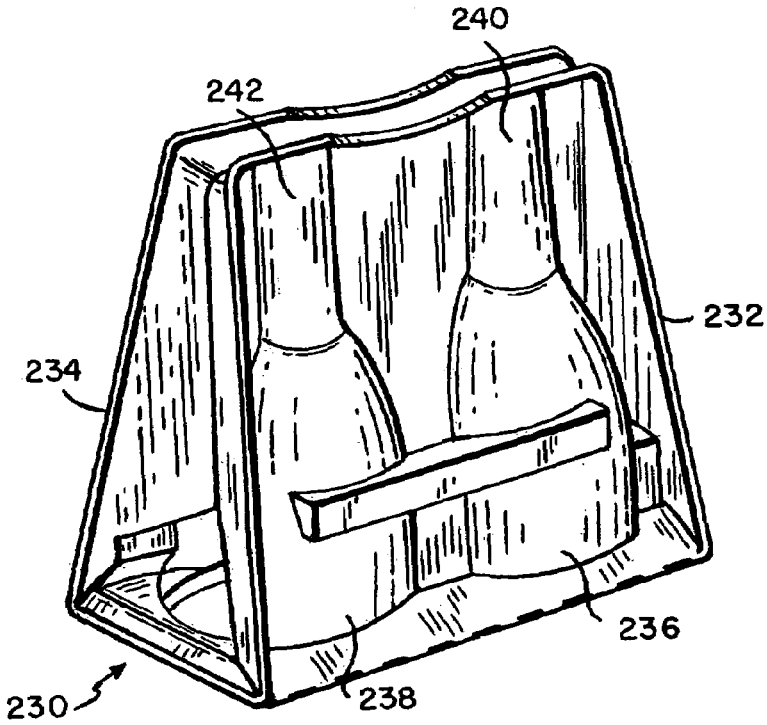
FIG. 15 a perspective view of an eleventh example of the multiple pack bottle holder of the present invention.

FIG. 15 depicts a further example of the bottle holder package of the present invention, which can be used for packaging bottles of a generally flatter configuration between the neck and tapered area, e.g., wine bottles having a capacity of 0.75 L. A bottle holder package 230 can include first and second sections 232 and 234 which are arranged in a flatter triangular cross-section, as compared with the previously described examples. The package includes complimentary first cut-outs 240 and 242 in the neck region of the bottles, which gradually widen into second cut-outs 236 and 238 in the tapered region of the bottles. By virtue of the smoother and flatter arrangement of bottles that are to be packaged in the holder package 230, the cross-section can accordingly be flattened to a configuration as shown in FIG. 15.

Figure 16A:
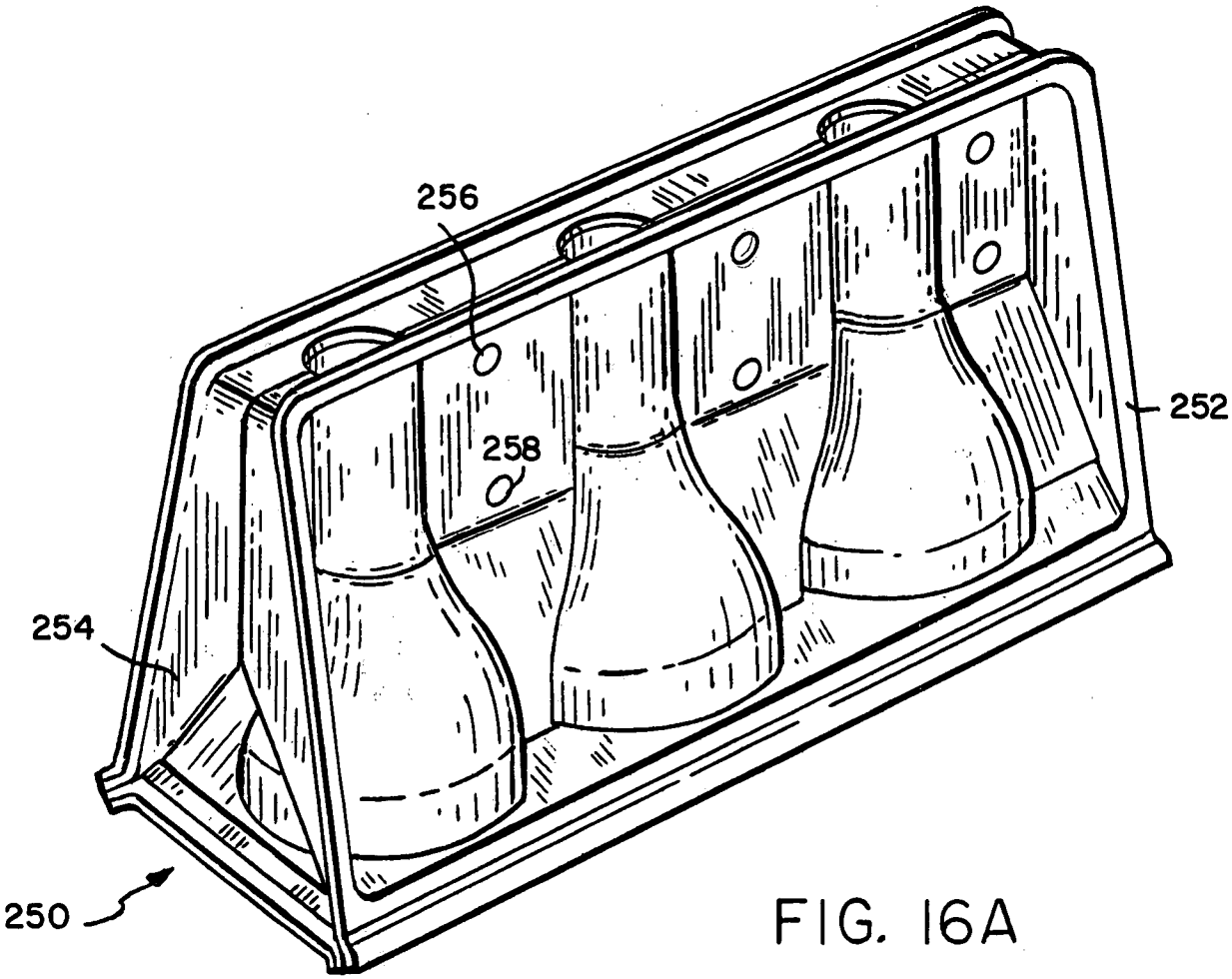
FIG. 16A is a perspective view of a further example of the multiple pack bottle holder of the present invention capable of holding three bottles.
Figure 16B:
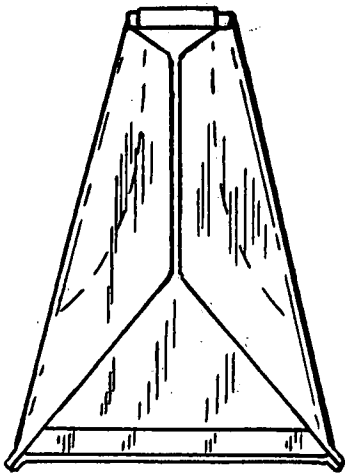
FIG. 16B is an end view of the bottle holder shown in FIG. 16A.

FIGS. 16A and 16B depict a further example of the bottle holder package of the present invention which is configured to hold three bottles. A three-pack bottle holder package 250 as depicted is similar to the above-described two-pack holder and includes additional buttons and corresponding enclosures for attachment of first and second sections 252 and 254, respectively. Preferably, there are at least two rows of buttons/enclosures 256 and 258 for providing sufficient strength to hold together the first and second sections.

Figure 17:
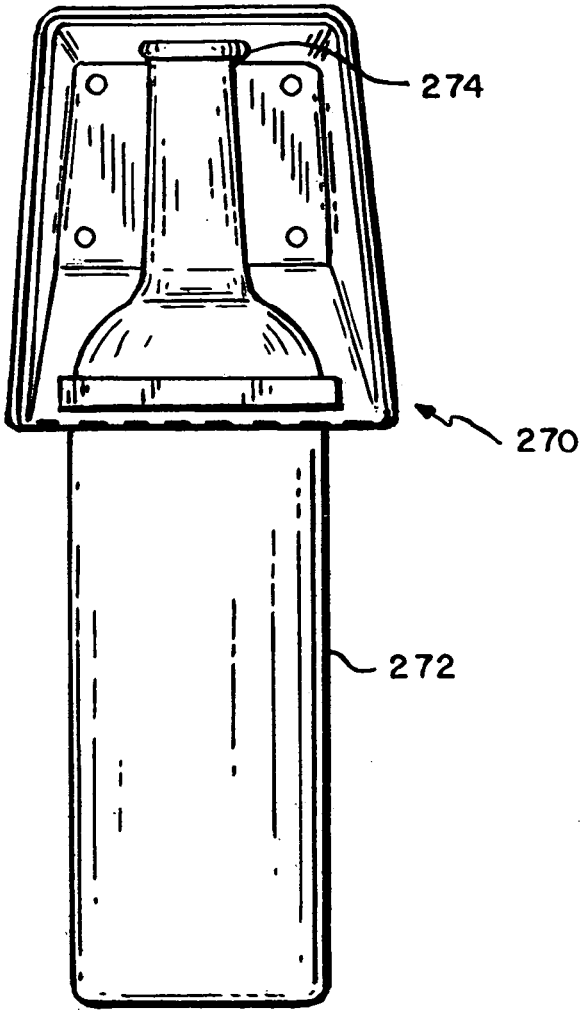
FIG. 17 is a cross-sectional side view of a single bottle holder according to the present invention.
Figure 18:
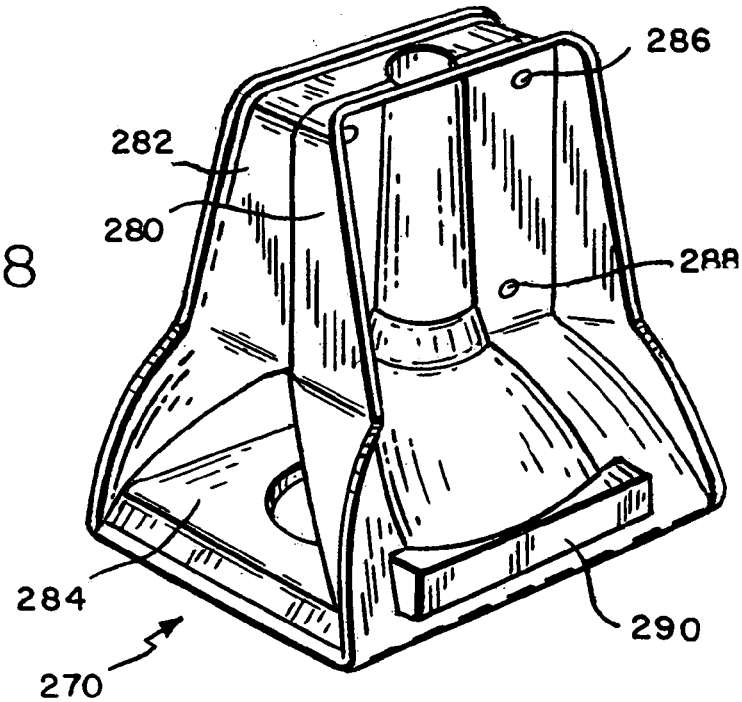
FIG. 18 is a perspective view of the single bottle holder of FIG. 17.

FIGS. 17 and 18 depict an example of a single bottle holder package 270 for gripping and holding a single bottle 272, for example, a 750 mL (0.75 L) or 1.5 L bottle. As in the aforementioned multiple pack bottle holders, the package 270 preferably encloses the bottle 272 around its neck, tapered region, and a portion of the barrel, the package supporting the bottle just below its rim 274. The package 270 includes first and second sections 280 and 282, respectively, which are separated by fold lines from a center section 284. Preferably, one or more rows 286, 288 of buttons and corresponding enclosures are provided to close the package. As in the multiple bottle packages, the single holder package 270 can include a banner area 290 on the first section 280 and/or the second section 282.

Although exemplary embodiments of the invention have been described using specific terms, such description is for illustrative purposes only, and it is to be understood that changes and variations may be made without departing from the spirit or scope of the following claims.

What is claimed is:

1. A bottle holder package for supporting at least one bottle entirely from a top portion of the bottle, comprising:

the at least one bottle having the top portion, a bottom, and a barrel, where the top portion includes at least a neck and a tapered portion of the bottle;

first and second complimentary sections, each section contoured in a same manner as the neck and the tapered portion of the bottle, the first and second complimentary sections contacting substantially the entire neck and tapered portion of the bottle without engaging the barrel;

a center section connected to the first and second sections by fold lines, the center section having at least one opening receiving the at least one bottle; and an attachment mechanism provided on the first and section sections for connecting the first and second sections to form a seal, thereby enclosing the bottle at the top portion.

2. The bottle holder package of claim 1, wherein the first and second sections include a cut-out for receiving the top portion of the bottle.

3. The bottle holder package of claim 1, wherein the first and second sections include a hand grip.

4. The bottle holder package of claim 3, wherein the hand grip is positioned within the first and second sections.

5. The bottle holder package of claim 4, wherein the hand grip has an oval shape.

6. The bottle holder package of claim 4, wherein the hand grip has a rectangular shape.

7. The bottle holder package of claim 4, wherein the hand grip is positioned on a support.

8. The bottle holder package of claim 1, and further including a handle projecting above the first and second sections.

9. The bottle holder package of claim 2, and further including a banner area positioned over the cut-out.

10. The bottle holder package of claim 1, and further including a placard arranged between the first and second sections.

11. The bottle holder package of claim 1, wherein the attachment mechanism includes a plurality of buttons on the first section and a plurality of corresponding enclosures on the second section.

12. The bottle holder package of claim 1, wherein the bottle holder package is made of molded plastic.

13. The bottle holder package of claim 12, wherein the molded plastic is made from polyvinyl chloride.

14. The bottle holder package of claim 1, and further including a gripping area at the top of the first and second sections.

15. The bottle holder package of claim 14, wherein the gripping area includes a rounded relief.

16. The bottle holder package of claim 14, wherein the gripping area includes a finger pattern.

17. The bottle holder package of claim 16, wherein the finger pattern is made up of alternating ridges and valleys.

18. The bottle holder package of claim 1, wherein the bottle holder package is configured to hold more than two bottles.

19. A package for holding a plurality of bottles entirely from a top portion of the bottles, comprising:

the plurality of bottles, each bottle having the top portion including at least a neck and a tapered portion, a bottom, and a barrel;

a first section contoured in a same manner as the neck and the tapered portion of each bottle;

a second section contoured in a same manner as the neck and the tapered portion of each bottle, the first and second complimentary sections contacting substantially the entire neck and tapered portion of each bottle without engaging the barrel;

a center section connected to the first and second sections by fold lines, the center section having a plurality of openings receiving the plurality of bottles; and an attachment mechanism provided on each of the first and second sections for attaching the first section to the second section to form a seal, the first and second sections supporting the bottles from the neck and the tapered portion of each bottle, without enclosing the bottom of each bottle.

20. The bottle holder package of claim 19, wherein the first and second sections include cut-outs for receiving the top portions of the bottles.

21. The package of claim 19, wherein the first and second sections include a hand grip.

22. The package of claim 21, wherein the hand grip is positioned within the first and second sections.

23. The package of claim 22, wherein the hand grip has an oval shape.

24. The package of claim 22, wherein the hand grip has a rectangular shape.

25. The package of claim 22, wherein the hand grip is positioned on a support.

26. The package of claim 19, and further including a handle projecting above the first and second sections.

27. The package of claim 20, and further including a banner area positioned over the cut-outs.

28. The package of claim 19, and further including a placard arranged between the first and second sections.

29. The package of claim 19, wherein the attachment mechanism includes a plurality of buttons on the first section and a plurality of corresponding enclosures on the second section.

30. The package of claim 19, wherein the bottle holder package is made of molded plastic.

31. The package of claim 30, wherein the molded plastic is made from polyvinyl chloride.

32. The package of claim 20, and further including a gripping area at the top of the first and second sections between the cut-outs.

33. The package of claim 32, wherein the gripping area includes a rounded relief.

34. The package of claim 32, wherein the gripping area includes a finger pattern.

35. The package of claim 34, wherein the finger pattern is made up of alternating ridges and valleys.

36. The bottle holder package of claim 19, wherein the bottle holder package is configured to hold two bottles.

37. The bottle holder package of claim 19, wherein the bottle holder package is configured to hold more than two bottles.

38. A method for packaging one or more bottles by supporting the bottles entirely from a top portion of the bottles, comprising the steps of:

providing the one or more bottles, each bottle having the top portion including at least a neck and a tapered portion, a bottom, and a barrel;

providing a bottle holder package having first and second sections connected to a center section by fold lines, the first and second sections contoured in a same manner as the neck and the tapered portion of each bottle, wherein the first and second complimentary sections are provided to contact substantially the entire neck and tapered portion of each bottle without engaging the barrel;

erecting the bottle holder package by folding the first and second sections along the fold lines;

enclosing each bottle in the bottle holder package, the first and second sections extending around the neck and the tapered portion of each bottle, without enclosing the bottom of each bottle; and closing the bottle holder package by forming a seal between the first and second sections to support an entire weight of the one or more bottles in the bottle holder package.

39. A method for packaging a plurality of bottles in a bottle holder package by supporting the bottles entirely from a top portion of the bottles, the package having first and second sections each connected to a center section by fold lines, the first and second sections contoured in a same manner as a neck and a tapered section of each bottle, the method comprising the steps of:

folding the first section along the fold line with the center section;

folding the second section along the fold line with the center section;

receiving the bottles in a plurality of holes in the center section;

connecting the first section to the second section by engaging buttons in the first section with corresponding enclosures in the second section such that the first and second complimentary sections contact substantially the entire neck and tapered portion of each bottle without engaging a barrel, thereby supporting the bottles entirely from the neck and the tapered section of each bottle.

40. The method of claim 39, and further including a step of positioning the first and second sections under a rim of each bottle.

41. The method of claim 39, and further including a step of gripping the package by a curved relief at the top of the first and second sections.

42. The method of claim 39, and further including a step of gripping the package by a hand grip arranged within the first and second sections.

43. The method of claim 39, and further including a step of gripping the package by a handle projecting above the first and second sections.

* * * * *